United States Patent [19]

Choi

[11] Patent Number: 4,968,070

[45] Date of Patent: Nov. 6, 1990

[54] PUSH BAR DOGGING APPARATUS

[75] Inventor: Mansam Choi, Monrovia, Calif.

[73] Assignee: Adams Rite Manufacturing Company, City of Industry, Calif.

[21] Appl. No.: 396,373

[22] Filed: Aug. 21, 1989

[51] Int. Cl.[5] ..... E05C 15/02

[52] U.S. Cl. ..... 292/92; 70/92

[58] Field of Search ..... 292/92, 21, 93; 70/92

[56] References Cited

U.S. PATENT DOCUMENTS

| | | | |
|---|---|---|---|
| 1,141,338 | 6/1915 | Hill . | |
| 1,161,972 | 11/1915 | Rehfuss . | |
| 3,011,330 | 12/1961 | Eads . | |
| 3,011,817 | 12/1961 | Eads . | |
| 3,097,007 | 7/1963 | Eichacker et al. . | |
| 3,214,947 | 11/1965 | Wikkerink . | |
| 3,271,982 | 9/1966 | Welch . | |
| 3,345,099 | 10/1967 | Paul et al. . | |
| 3,368,374 | 2/1968 | Eads . | |
| 3,614,145 | 8/1970 | Zawadzki . | |
| 3,663,047 | 5/1972 | Zawadzki | 292/92 |
| 3,866,730 | 2/1975 | Balducci . | |
| 3,869,159 | 3/1975 | Eads . | |
| 3,873,141 | 3/1975 | Peterson . | |
| 4,083,590 | 4/1978 | Folger | 292/92 |
| 4,218,903 | 8/1980 | Eads . | |
| 4,458,928 | 7/1984 | Hirschbein . | |
| 4,624,490 | 11/1986 | Miller | 292/92 |
| 4,785,286 | 11/1988 | Martin | 292/92 |
| 4,839,988 | 6/1989 | Betts | 292/92 |

*Primary Examiner*—Robert L. Wolfe

*Attorney, Agent, or Firm*—William W. Haefliger

[57] ABSTRACT

A door latching or unlatching push bar apparatus comprising: a mounting rail means to be carried by the door, the rail means having a locking rail; a push bar mounted for advancement and retraction relative to the rail means; support means carried by the push bar to extend toward the rail means, and a lock arm carried by the support means to be movable into and out of dogging position relative to the locking rail; and an actuator carried by the push bar and operatively connected with the lock arm to move the lock arm into and out of dogging position when the push bar has been advanced toward the rail means.

13 Claims, 5 Drawing Sheets

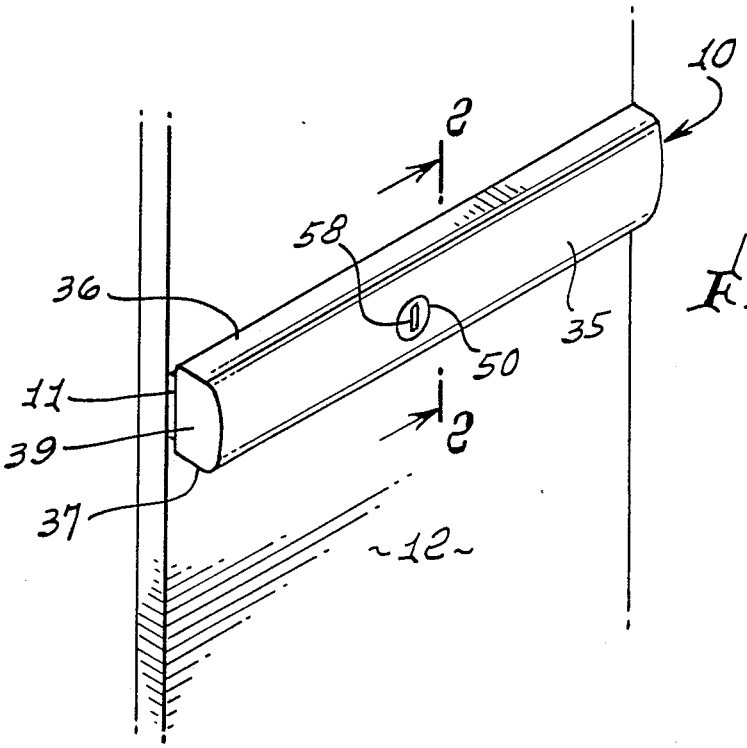
FIG. 1.
FIG. 2.
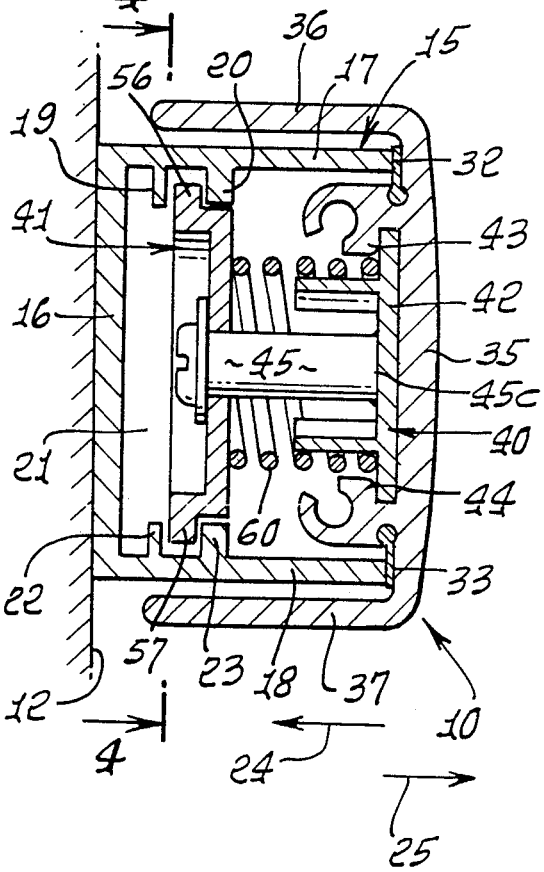
FIG. 3.
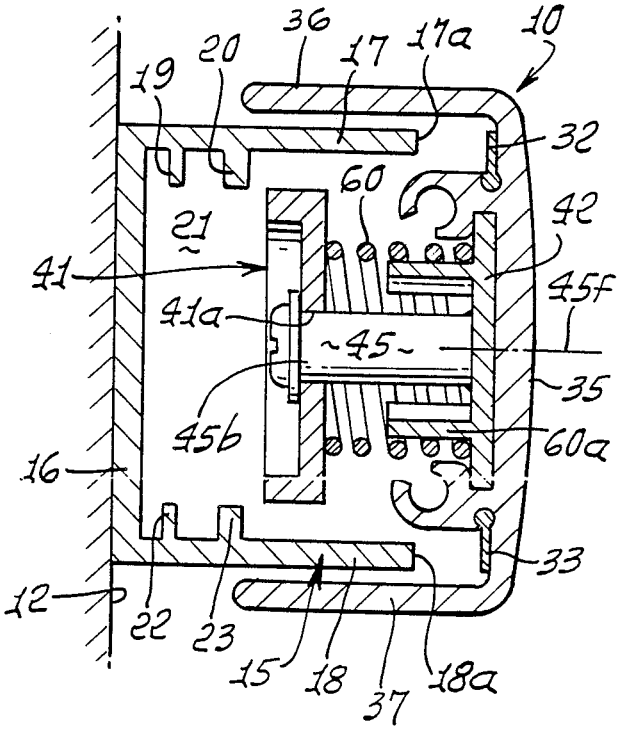

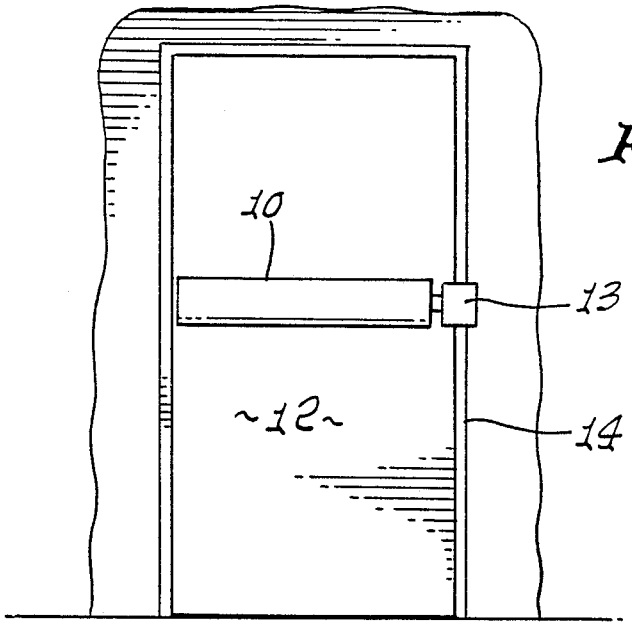
FIG. 1a.
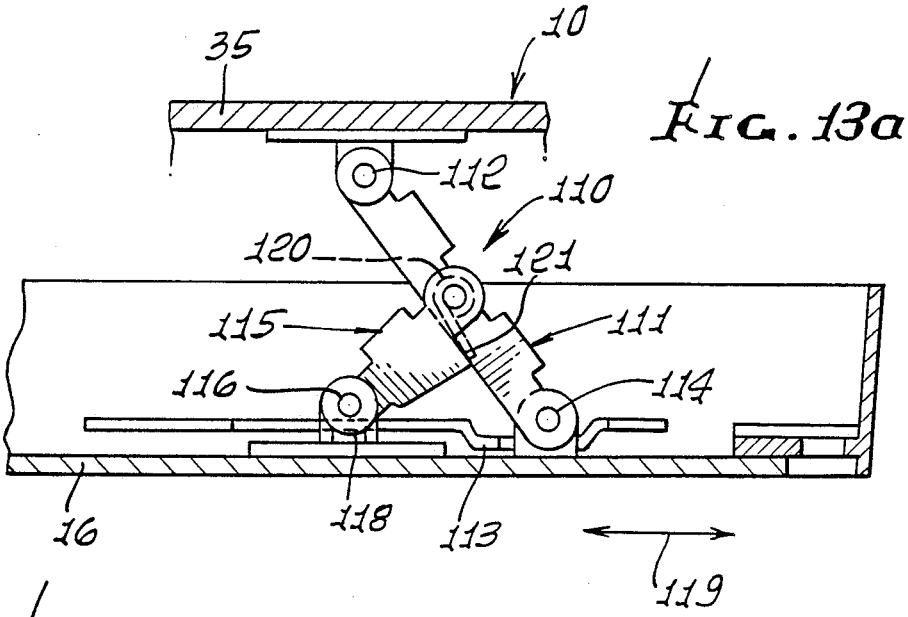
FIG. 13a.
FIG. 13b.
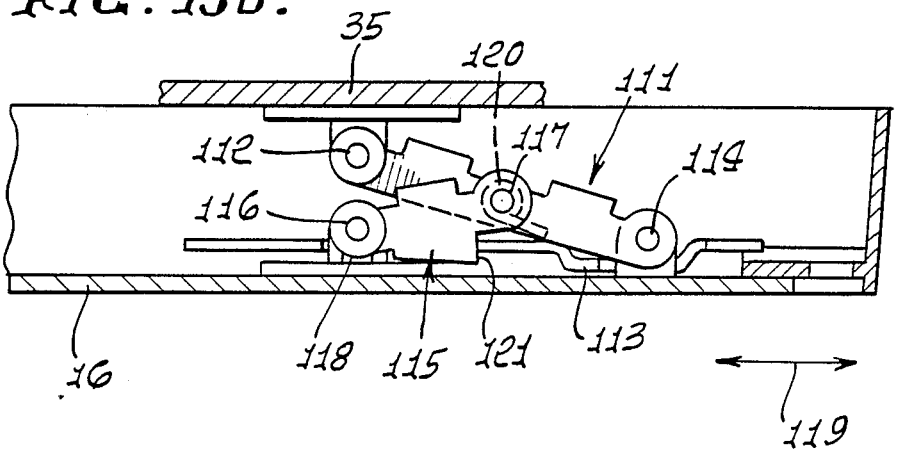

36
56
41
17
20
10
92
35
80a
80b
53
90a
83
50
52
48
55
51
42
54
15
57
37
91
90
18
23

17
56
20
92
36
90
41
54
81b
91
90a
80a
51
50
42
81a
83
55
80b
52
23
15
57
10
18
37
35

PUSH BAR DOGGING APPARATUS

BACKGROUND OF THE INVENTION

This invention relates generally to door opening and closing apparatus, and more particularly, to the locking or "dogging" of push bars such as are employed on doors for panic exiting through doorways.

When a push bar is installed on a door, it operates to release a door latching device, when the bar is pushed in. Typically, during business hours, the push bar is "dogged" to remain in pushed-in position so that the door latch remains released, i.e., all internal locking mechanisms are retained or secured in position so as not to operate. There is need for simple, efficient dogging apparatus, and in particular, dogging apparatus operable in conjunction with turning of a lock cylinder associated with a push bar.

SUMMARY OF THE INVENTION

It is a major object of the invention to provide improved push bar dogging apparatus meeting the above need. Basically the improved apparatus comprises:

(a) a mounting rail means to be carried by the door, the rail means having a locking rail, (b) a push bar mounted for advancement and retraction relative to the rail means, (c) support means carried by the push bar to extend toward the rail means, and a lock arm carried by the support means to be movable into and out of dogging position relative to the locking rail, (d) and an actuator carried by the push bar and operatively connected with the lock arm to move the lock arm into and out of the dogging position when the push bar has been advanced toward the rail means.

As will be seen, the support means and lock arm advantageously have lost-motion connection allowing the push bar and support means to be displaced relative to the lock arm toward the rail means, despite inadvertent movement of the lock arm into a dogging position prior to the advancement of the push bar. Also, the lock arm movement may advantageously be in a rotary direction, the actuator then being rotatably carried by the push bar and having rotary cam and follower operative connection with the lock arm.

It is another object of the invention to provide the support means to include a shaft extending through a through-opening in the lock arm, thereby defining the lost motion connection, the shaft extending in the direction of push bar movement.

A further object includes the provision of detent means releasably coupling the lost motion connection shaft to the lock arm to prevent rotation of the lock arm in the absence of actuator rotation of the lock arm.

Another object includes the provision of an anti-rotation device carried by the push bar and engaged with the cylinder to prevent rotation thereof; and the provision of that device to have arm retained by rails defined by the mounting rail means.

These and other objects and advantages of the invention, as well as the details of an illustrative embodiment, will be more fully understood from the following specification and drawings, in which:

DRAWING DESCRIPTION

FIG. 1 is an enlarged, perspective view of a push bar mounted to a door, enabling panic unlatching of the door;

FIG. 1*a* is a diagrammatic view of the push bar in relation to the door latching means;

FIG. 2 is an enlarged vertical section taken on lines 2—2 of FIG. 1, the push bar shown in pushed-in, dogged, position;

FIG. 3 is a view like FIG. 2, showing the push bar in retracted, undogged position;

FIGS. 13*a* and 13*b* are sections showing push bar positions of retraction and advancement.

DETAILED DESCRIPTION

Figure 4:
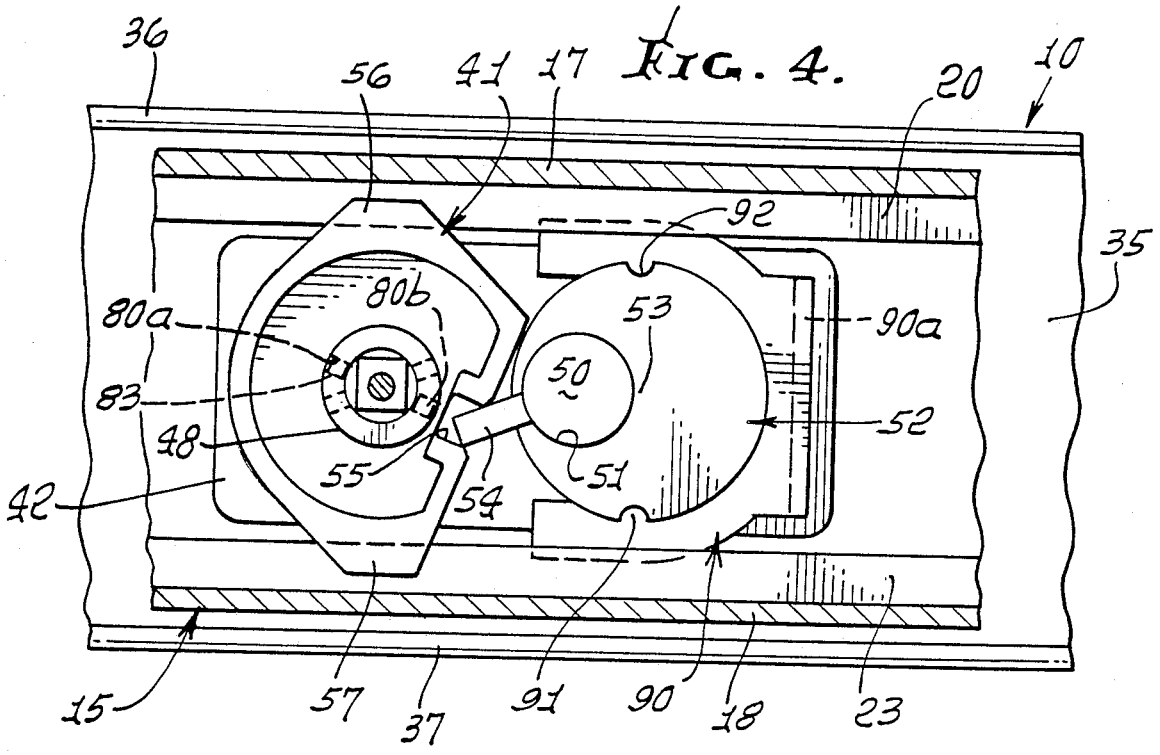
FIG. 4 is a vertical section taken on lines 4—4 of FIG. 2, and depicting a lock arm in dogging position relative to a mounting rail.

Referring first to FIGS. 1, 1*a* and 2, a push bar (i.e., panic exit bar) 10 is carried by structure 11 on a door 12. When the laterally extending bar is pushed toward the door, latching structure 13 is operated to retract a latch dog from a catch in a door frame 14, whereby the door may then be quickly opened. Structure 13 may take many different forms, and one such structure is described and shown in U.S. Pat. No. 3,614,145. Others may be employed.

Referring next to FIGS. 2 and 3, a mounting rail means 15 is attached or mounted to door 12 to extend laterally horizontally. It includes base 16 and upper and lower flanges 17 and 18 projecting away from the base 16 and the door. Two upper rails 19 and 20 are integral with the flange 17 and project downwardly into space 21 between flanges 17 and 18; and two lower rails 22 and 23 are integral with the flange 18 and project upwardly into space 21. Grooves are formed between 19 and 20, and between 22 and 23.

Push bar 10 is mounted for advancement (see arrow 24) and retraction (see arrow 25) relative to the rail means 15, as for example is diagrammatically seen in FIGS. 13*a* and 13*b*. FIG. 13*a* shows the push bar 10 in retracted position; and FIG. 13*b* shows the bar 10 in advanced position. Scissors structure 110 interconnects the bar 10 with the base 16 and guides the bar as it moves to maintain it parallel to 16. Two such structures 110 are provided at locations spaced along the length of the bar. Each scissors structure includes a link 111 pivotally connected to the bar at 112, and to a slider 113 at 114, and a link 115 pivotally connected to the base at 116 and to the link 111 at 117. Slider 113 is elongated and slides in a bearing at 118, in the direction of arrows 119. A coil spring 120 is wound about the axis of the pivot connection 117 and yieldably resists relative pivoting of the links to their positions as seen in FIG. 13*b*. Interengagement of link shoulders at 121 in FIG. 13*a* limits retraction of the push bar 10. Door latch operating mechanism appears at FIG. 13*a*. Bumpers 32 and 33, carried by the push bar, are engagable with the flange terminals 17*a* and 18*a* to limit push bar advancement in the direction of arrow 24. See FIG. 2. The push bar 10 includes a front upright panel 35 generally parallel to base 16, and upper and lower flanges 36 and 37 extending as shown, flange 36 parallel to and closely above flange 17; and flange 37 parallel to and closely below flange 18. Push bar end walls 39 extend between 35-37 at each end of the bar, as seen in FIG. 1.

Support means 40 is carried by the push bar to extend or project toward or within the rail means 15, and a lock arm 41 is carried by the support means to be movable into and out of dogging position relative to the locking rail. In the example, the support means 40 includes a holder plate 42 captivated next to panel 35, at the inner side thereof, by two retainers 43 and 44 integral with 35, as shown. The support means also includes a shaft 45, one end 45*c* of which is integral with plate 42, and the free end 45*b* of which projects freely forwardly toward base 16 and toward space 21, between flanges 17 and 18. The lock arm 41 is advantageously carried by the shaft 45 to be rotatable about the shaft axis 45*f*, at or near the shaft end 45*b*. Note the lock arm bore 41*a* closely receiving the shaft in bearing relation. Referring to FIGS. 2, 3, 8 and 9, the lock arm 41 is retained on the shaft, as for example by the fastener 47 and a washer 48. The fastener head 47*a* engages the washer 48 to retain the washer to the shaft end, and the washer may have a polygonal bore at 48*a* to engage corresponding polygonal shaft end outer surface 45*d*. Accordingly, the washer is prevented from rotating relative to the non-rotating shaft for purposes as will appear.

Figure 5:
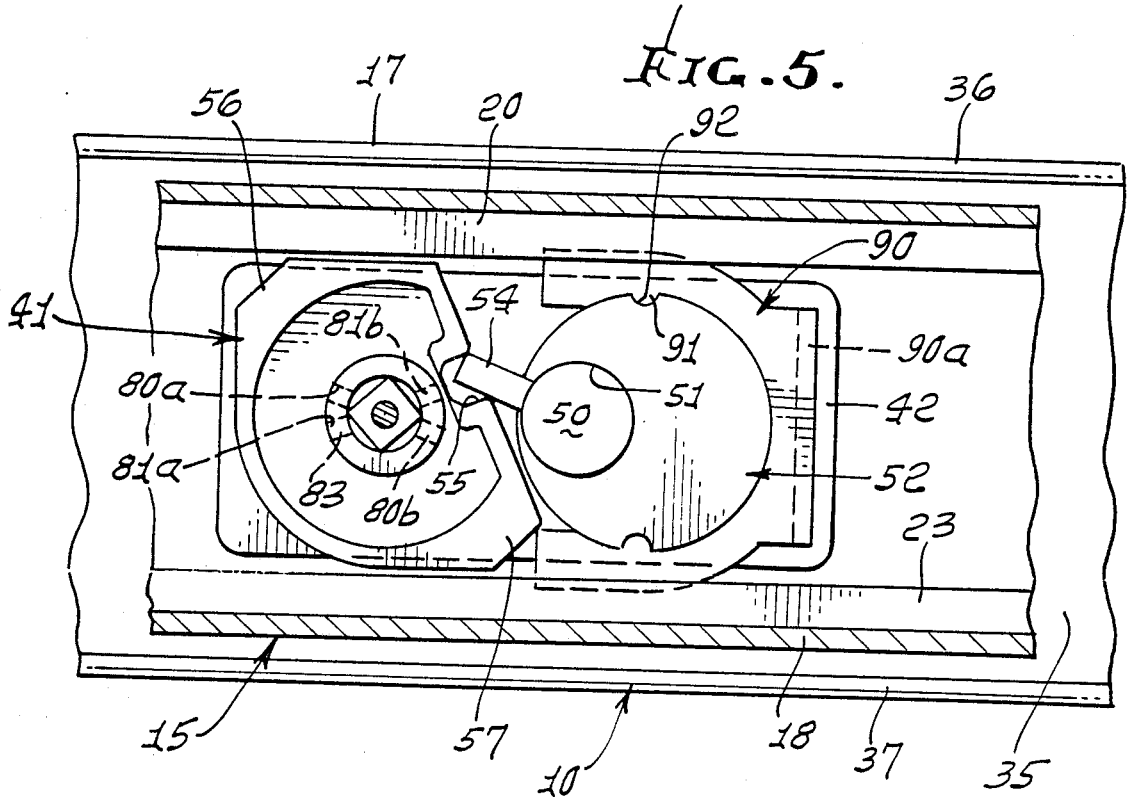
FIG. 5 is a view like FIG. 4 showing the lock arm rotatably displaced to undogging position relative to the mounting rail.

An actuator is carried by the push bar and operatively connected with the lock arm to move the lock arm into and out of the dogging position when the push bar has been advanced toward the rail means. In the example, the actuator is in the form of a rotor rotatably carried by or on the push bar, and has rotary cam and follower operative connection with the lock arm. For example, as seen in FIGS. 4 and 5, the rotor 50 is cylindrical to rotate within a bore 51 in a lock cylinder 52, the bore eccentrically located relative to the axis 53 of the cylinder 52. As the rotor 50 is rotated counterclockwise, a dog or cam 54 carried by and projecting sideways from the rotor, and fitting in a follower 55 on lock arm 41, causes the follower to rotate clockwise, as for example to the position of FIG. 4. Such rotation of the lock arm 41 causes dogs 56 and 57 on the lock arm 41 to rotate into FIG. 4 position, i.e., between rails 19 and 20, and between rails 22 and 23, as shown, assuming the push bar has been pushed in to FIG. 2 position. For this purpose, a key may be inserted into keyway 58 in the end of the rotor 50 (see FIG. 1) to rotate it. At this time, the push bar is in "dogged" position, i.e., held in door unlatching position. Note that a coil spring 60 retained between plate 42 and lock arm 41 to yieldably position the lock arm 41 adjacent washer 48, thereby to align the dogs 56 and 57 to enter between the rails, as in FIG. 2.

Conversely, when it is determined that the push bar is to be released from dogged condition, the rotor 50 is rotated clockwise, i.e., to FIG. 5 position, which retracts the dogs from between the rails and allows the push bar to retract to FIG. 3 position.

Figure 6:
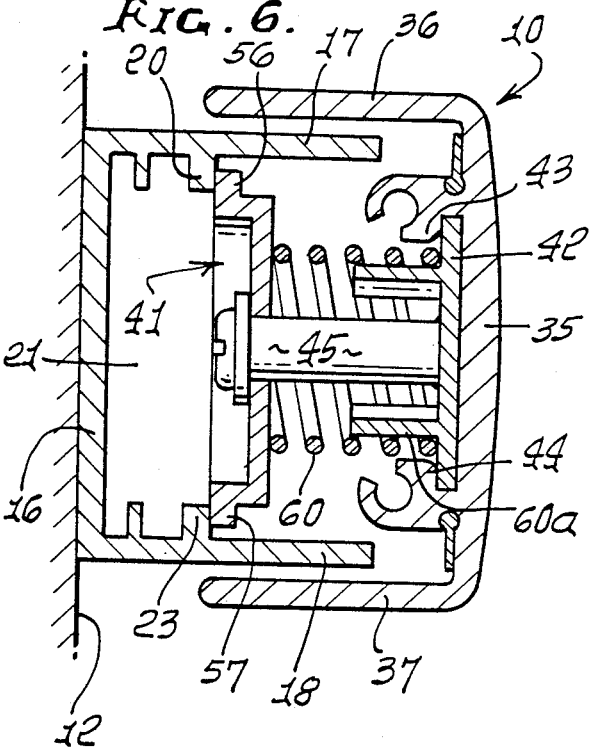
FIG. 6 is a view like FIG. 3, but showing the lock arm rotated to dogging position before the push bar is pushed in to door unlatching position.
Figure 7:
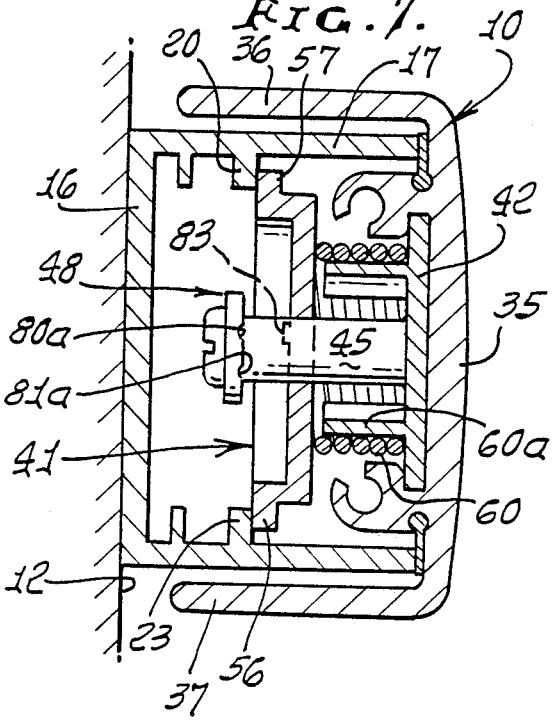
FIG. 7 is a view like FIG. 6 showing capability of the push bar to be pushed in (to release the door latch) despite prior positioning of the lock arm in dogging position.
Figure 8:
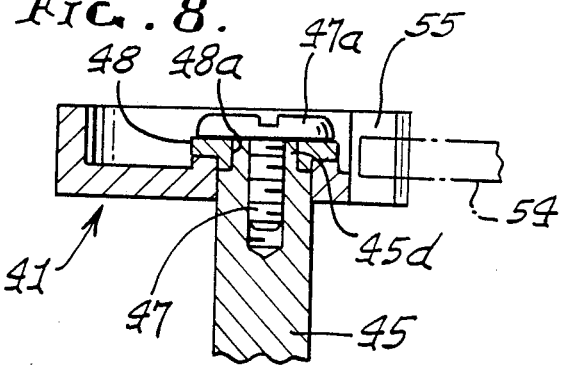
FIG. 8 is a fragmentary sectional assembly view showing detenting of the lock arm to a shaft preventing rotation of the lock arm relative to the shaft.
Figure 9:
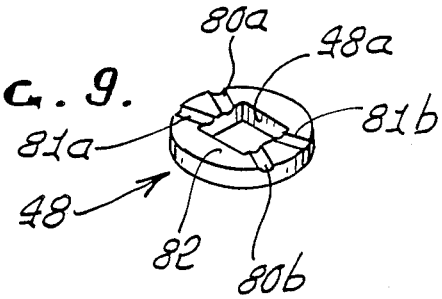
FIG. 9 is a perspective view of a detent washer employed in the assembly of FIG. 8.

It will be noted that the support means and lock arm have lost-motion connection allowing the push bar and support means to be displaced relative to the lock arm toward the rail means, despite inadvertent movement of the lock arm into a "dogging" position prior to the advancement of the push bar. Thus, for example, the lost-motion connection is provided in the example by the rightward relative sliding capability of the lock arm 41 on the shaft 45. FIG. 6 shows the push bar in rightward released position, but the lock arm 41 rotated to bring dog 56 upwardly to the right of rail 20, and dog 57 downwardly to the right of rail 23. Such rotation of arm 41 may for example be inadvertent. Nevertheless, the push bar is not prevented from being pushed to the left into FIG. 7 (door unlatching position), due to the lost-motion connection, as referred to. FIG. 7 shows the arm 41 relatively displaced to the right on the shaft (i.e., the shaft is relatively displaced to the left by pushing the push bar) and the spring 60 is thereby compressed. Panic unlatching of the door is thereby enabled. Retraction of the push bar upon its manual release is assisted by spring 60. Sleeve 60*a* centers the spring.

A further aspect of the invention concerns a provision of detent means releasably attaching the shaft to the lock arm. Such detent means is shown in the form of shallow U-shaped grooves 80*a* and 80*b*, and 81*a* and 81*b* in the surface 82 of the washer that faces diametrically opposed tangs or tabs 83 provided at the inner surface 84 of the lock arm. See FIGS. 7–10. In FIG. 4 for example, the tangs are received in grooves 80*a* and 80*b*; and in FIG. 5, the tangs are received in grooves 81*a* and 81*b*. This serves to keep the arm 41 in either FIG. 4 or FIG. 5 position, but not to prevent shifting of the arm 41 between these position, as against predetermined resistance imposed by rotation of the tangs out of their U-shaped retention grooves. Spring 60 assists in this.

Figure 12:
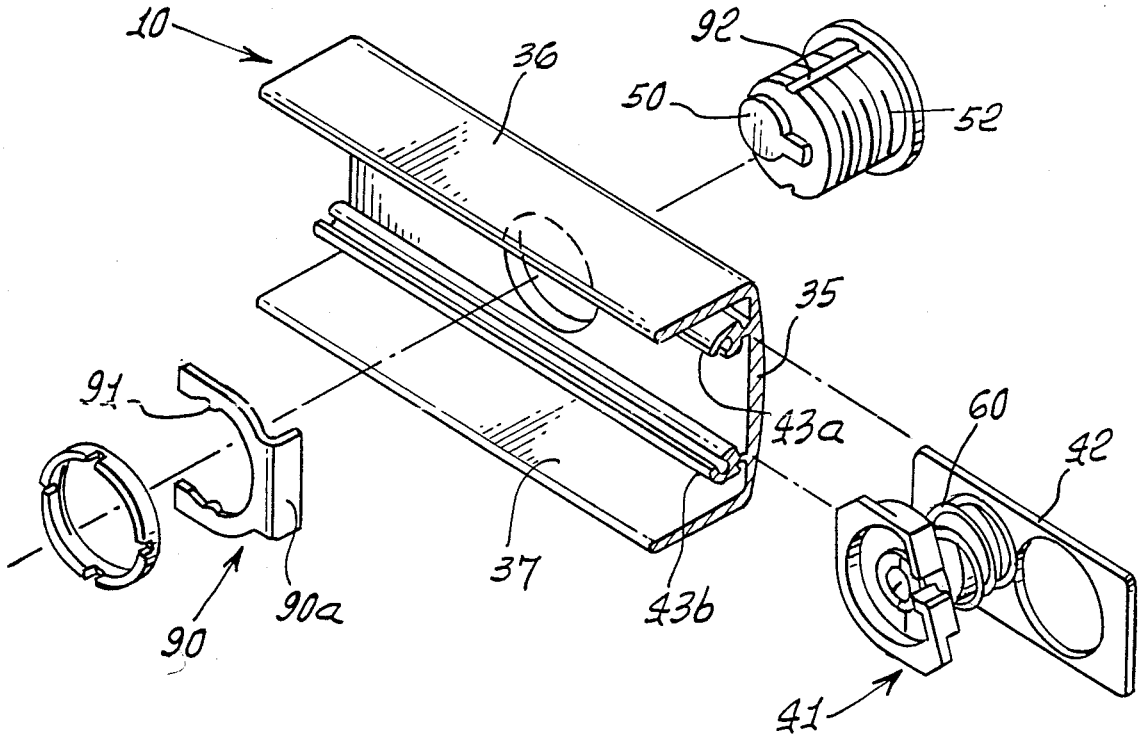
FIG. 12 is an exploded perspective view of the push bar, lock arm and lock arm actuator means, as also seen in FIGS. 4 and 5.

In FIGS. 4, 5 and 12, a U-shaped clip or bracket 90 has a flange 90*a* that projects between arms 43*a* and 44*a* on retainers 43 and 44 to prevent its rotation and to position it, whereby tangs 91 on the clip enter recesses 92 on the periphery of the lock cylinder 52 to prevent its rotation.

Figure 10:
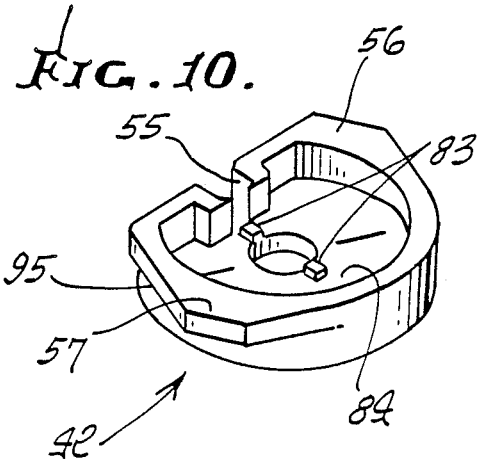
FIG. 10 is a perspective view of internal construction of the lock arm showing detenting tabs.
Figure 11:
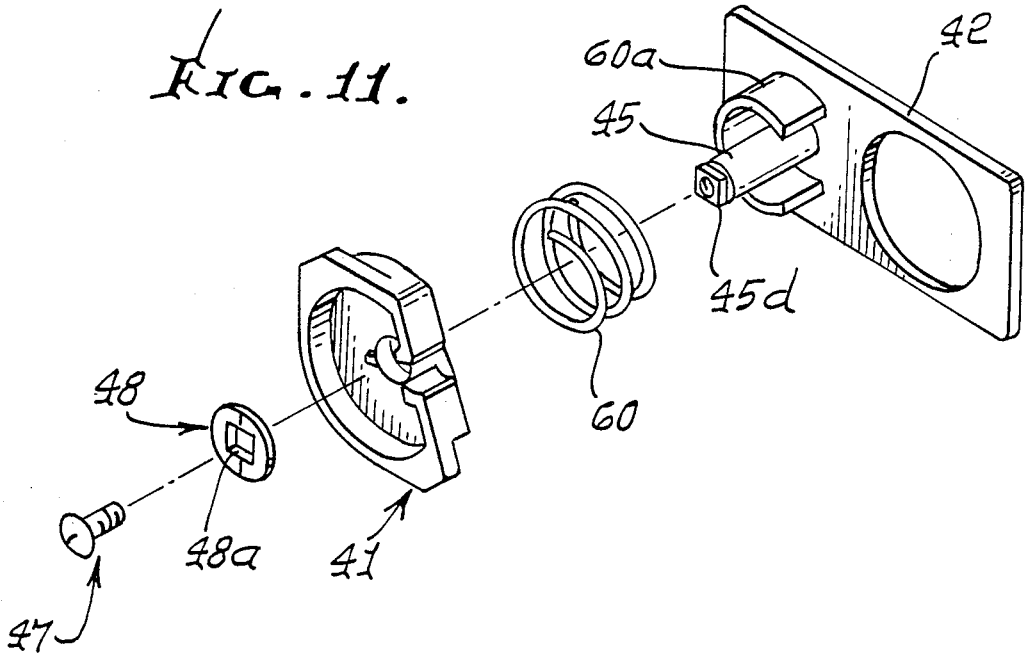
FIG. 11 is an exploded perspective view of the elements as seen in FIGS. 2 and 3.

Also, note that generally annular lock arm 41 is cup-shaped in FIG. 10 to provide a skirt 95 on which dogs 56 and 57 are mounted to project oppositely.

In operation during business hours, lock arm 41 dogs the push bar for non-operation of door locking mechanism. This requires all internal locking mechanisms to be secured so as not to operate. When the push bar is pushed in, a latch bolt (or any other similar locking device) is retracted, and the door remains unlocked. To accomplish this, the push bar is held pushed in, by the dogging mechanism.

The present invention provides simplified, but efficient dogging features to operate a with cylinder, considering that cylinder dogging is desirable for building management control. The present lock arm, which may be made of injection-molded plastic has specifically shaped flanges to be tucked under the "rail" in the rail means 15 when it is in the dogged-open position, as previously described and as shown. The compression spring 60 has dual functions. First, it keeps the lock arm 41 away from the holder 42 and stays in position for dogging (FIGS. 1–3).

Another function of the compression spring is to assist detenting of the lock in either dogging or undogging position only, not in between. This is accomplished by yieldably urging the tabs 83 into the U-shaped grooves in washer 48, as described.

I claim:

1. In door latching or unlatching push bar apparatus, the combination comprising:

(a) a mounting rail means to be carried by the door, the rail means having a locking rail, (b) a push bar mounted for advancement and retraction relative to the rail means, (c) support means carried by the push bar to extend toward the rail means, and a lock arm carried by the support means to be movable into and out of dogging position relative to the locking rail, (d) and an actuator carried by the push bar and operatively connected with the lock arm to move the lock arm into and out of said dogging position when the push bar has been advanced toward the rail means, (e) there being groove means associated with said locking rail, the lock arm having dog means rotatably movable into said groove means in said dogging position, the actuator having rotary cam and follower connection with the lock arm.

2. The combination of claim 1 wherein said support means and lock arm have lost-motion connection allowing the push bar and support means to be displaced relative to the lock arm toward the rail means, despite inadvertent movement of the lock arm into a dogging position prior to said advancement of the push bar.

3. The combination of claim 1 wherein said support means includes a shaft extending through the lock arm, the lock arm mounted on the shaft.

4. In door latching or unlatching push bar apparatus, the combination comprising:

(a) a mounting rail means to be carried by the door, the rail means having a locking rail, (b) a push bar mounted for advancement and retraction relative to the rail means, (c) support means carried by the push bar to extend toward the rail means, and a lock arm carried by the support means to be movable into and out of dogging position relative to the locking rail, (d) and an actuator carried by the push bar and operatively connected with the lock arm to move the lock arm into and out of said dogging position when the push bar has been advanced toward the rail means, (e) and wherein said movement of the lock arm into and out of dogging position is rotary movement, and said actuator is rotatably carried by the push bar and has rotary cam and follower operative connection with the lock arm.

5. The combination of claim 1 wherein said movement of the lock arm into and out of dogging position is rotary movement, and said actuator is rotatably carried by the push bar and has rotary cam and follower operative connection with the lock arm.

6. The combination of claim 4 wherein said movement of the lock arm into and out of dogging position is rotary movement, and said actuator is rotatably carried by the push bar and has rotary cam and follower operative connection with the lock arm.

7. The combination of claim 6 including detent means releasably coupling the shaft to the lock arm to prevent rotation of the lock arm in the absence of actuator rotation of the lock arm.

8. The combination of claim 6 including a rotary cylinder carried by the push bar, and carrying the actuator.

9. The combination of claim 8 including an anti-rotation device carried by the push bar and engaged with the cylinder to prevent rotation thereof.

10. The combination of claim 9 wherein said device is U-shaped and defines arms retained by rails defined by said mounting rail means.

11. In door latching or unlatching push bar apparatus, the combination comprising:

(a) a mounting rail means to be carried by the door, the rail means having a locking rail, (b) a push bar mounted for advancement and retraction relative to the rail means, (c) support means carried by the push bar to extend toward the rail means, and a lock arm carried by the support means to be movable into and out of dogging position relative to the locking rail, (d) and an actuator carried by the push bar and operatively connected with the lock arm to move the lock arm into and out of said dogging position when the push bar has been advanced toward the rail means, (e) and wherein the mounting means defines two pairs of said locking rails, the rails of each pair spaced apart to define grooves, the lock arm having dogs movable into said grooves in said dogging position.

12. The combination of claim 11 wherein said pairs of grooves are spaced apart to receive the lock arm therebetween to position said dogs for movement into and out of said grooves.

13. The combination of claim 7 wherein the detail means includes a washer having a polygonal bore to interfit a corresponding polygonal surface of said shaft.

* * * * *